US011896067B2

(12) United States Patent
Magdlen

(10) Patent No.: US 11,896,067 B2
(45) Date of Patent: Feb. 13, 2024

(54) HOOD WITH FACE MASK

(71) Applicant: Alera H. Magdlen, Los Angeles, CA (US)

(72) Inventor: Alera H. Magdlen, Los Angeles, CA (US)

( * ) Notice: Subject to any disclaimer, the term of this patent is extended or adjusted under 35 U.S.C. 154(b) by 125 days.

(21) Appl. No.: 17/444,650

(22) Filed: Aug. 6, 2021

(65) Prior Publication Data

US 2022/0039497 A1 Feb. 10, 2022

Related U.S. Application Data

(60) Provisional application No. 63/109,253, filed on Nov. 3, 2020, provisional application No. 63/063,130, filed on Aug. 7, 2020.

(51) Int. Cl.

| | |
|---|---|
| ***A41D 15/04*** | (2006.01) |
| ***A41D 13/11*** | (2006.01) |
| ***A41D 13/00*** | (2006.01) |

(52) U.S. Cl.

CPC ..... *A41D 15/04* (2013.01); *A41D 13/1107* (2013.01); *A41D 13/1161* (2013.01); *A41D 13/0012* (2013.01); *A41D 2200/20* (2013.01)

(58) Field of Classification Search

CPC A41D 13/11; A41D 13/1153; A41D 13/1161; A41D 13/05; A24B 1/04; A31D 13/1107; A31D 13/0012; A31D 2200/20

See application file for complete search history.

(56) References Cited

U.S. PATENT DOCUMENTS

| | | | | |
|---|---|---|---|---|
| 2,839,757 | A | 6/1958 | Gianola | |
| 3,561,010 | A * | 2/1971 | Little | A42B 1/046 2/84 |
| 5,713,077 | A * | 2/1998 | Humbrecht | A42B 1/0182 2/202 |
| 5,909,802 | A * | 6/1999 | Puco | A45F 3/04 224/148.1 |
| 6,023,787 | A * | 2/2000 | French | A42B 1/048 2/202 |
| 6,397,395 | B1 | 6/2002 | DeHart | |
| D566,902 | S | 4/2008 | Van Trojen | |
| 7,418,740 | B2 | 9/2008 | Anderson et al. | |
| 9,521,873 | B1 | 12/2016 | Mignone | |
| D843,689 | S | 3/2019 | Kinnear | |
| 2011/0185482 | A1* | 8/2011 | Godfrey | A41D 13/1161 2/455 |
| 2013/0139291 | A1* | 6/2013 | Ko | A41D 3/005 2/84 |
| 2014/0096305 | A1 | 4/2014 | Friesen | |

(Continued)

FOREIGN PATENT DOCUMENTS

| | | |
|---|---|---|
| KR | 101310694 | 9/2013 |
| KR | 101740995 | 5/2017 |
| KR | 101924759 | 11/2018 |

*Primary Examiner* — Clinton T Ostrup
*Assistant Examiner* — Brianna T. Duckworth
(74) *Attorney, Agent, or Firm* — Knobbe, Martens, Olson & Bear, LLP

(57) ABSTRACT

A hooded garment including a tether that enables the hood to be secured in place in a mask configuration with a breathable filtration material disposed over the nose and mouth area of a wearer's face and secured in place with a tether attached to the ear of the wearer.

9 Claims, 11 Drawing Sheets

(56) References Cited

U.S. PATENT DOCUMENTS

| | | | | |
|---|---|---|---|---|
| 2015/0201681 | A1* | 7/2015 | Ron | A41D 3/00 2/84 |
| 2016/0015099 | A1 | 1/2016 | Saladino | |
| 2016/0374415 | A1* | 12/2016 | Chang | A41D 15/00 2/69 |
| 2017/0055597 | A1 | 3/2017 | Lekven | |
| 2017/0079343 | A1 | 3/2017 | Chen | |
| 2017/0119076 | A1* | 5/2017 | Marji | A42B 1/048 |
| 2018/0168258 | A1 | 6/2018 | Solle et al. | |
| 2018/0271189 | A1 | 9/2018 | Hussey et al. | |
| 2019/0297980 | A1* | 10/2019 | Celaya | A42B 1/06 |
| 2021/0298376 | A1* | 9/2021 | Stern | A41D 27/18 |
| 2021/0345700 | A1* | 11/2021 | Krulik | A47K 5/1211 |

* cited by examiner

HOOD WITH FACE MASK

PRIORITY

Reference is made to U.S. Provisional Application No. 63/063,130 filed on Aug. 7, 2020, and U.S. Provisional Application No. 63/109,253 filed on Nov. 3, 2020 the entirety of which are hereby incorporated by reference.

BACKGROUND

Field

The present disclosure generally relates to a garment including a mask as a single article of clothing.

Related Art

In recent times, there has been an increased awareness and concern for preventing the spread of contaminants from person-to-person through airborne pathogens, fluids, particulate matters, aerosols, or other infectious contaminants. In addition, outdoor conditions such as cold air and harmful UV rays remain a constant and often unforeseeable hazard. As a result, many people wear face masks during at least part of their day.

SUMMARY

One aspect of the present disclosure is a garment that includes a built-in or attachable hood that can be worn alternatively on a wearer's head, resting on the wearer's back or wrapped across the wearer's nose and/or mouth as a face mask. When configured as a mask, a tether or other attachment device can secure the hood in place across the wearer's face. In certain implementations, a mask portion of the hood can be aligned with the wearer's nose and/or mouth when configured as a mask. The mask portion can be located in a crown region of the hood. The mask portion can include a breathable filtration layer. The breathable filtration layer can include one or more layers of the hood and/or a filtration material. The filtration material can be removable and/or replaceable. In certain applications, the tether can include a loop attached with an outer hem or edge of the hood. In certain applications, the hood can be wrapped around a first side of the wearer's head and the tether can couple the hood in place as a mask on a second side of the wearer's head. In certain implementations, the tether can coupled with a wearer's ear. In other implementations, the tether can be secured with the garment itself such as on the hood, a shoulder portion, a sleeve portion, or a collar portion of the garment.

According to another aspect, the mask portion of the hood can include a pocket region. The pocket region can include a double layer of a textile material forming a pocket. The filtration layer can be insertable within the pocket formed by the two layers. The pocket can be optionally closeable and openable. The filtration layer can be disposable and replaceable with the pocket.

Another aspect of the present disclosure is an attachment device for a garment including a hood. The attachment device can be configured to secure to the hood, such as an edge of the hood. The attachment device can secure the hood in a mask configuration with the hood wrapped around a first side of a wearer's face and across the nose and/or mouth of the wearer. The attachment device can include a tether that coupled with the wearer's ear on a second side of the wearer's face. Alternatively, the attachment device can secure with the garment itself such as on the hood, a shoulder portion, a sleeve portion, or a collar portion of the garment.

DETAILED DESCRIPTION

Figure 1:
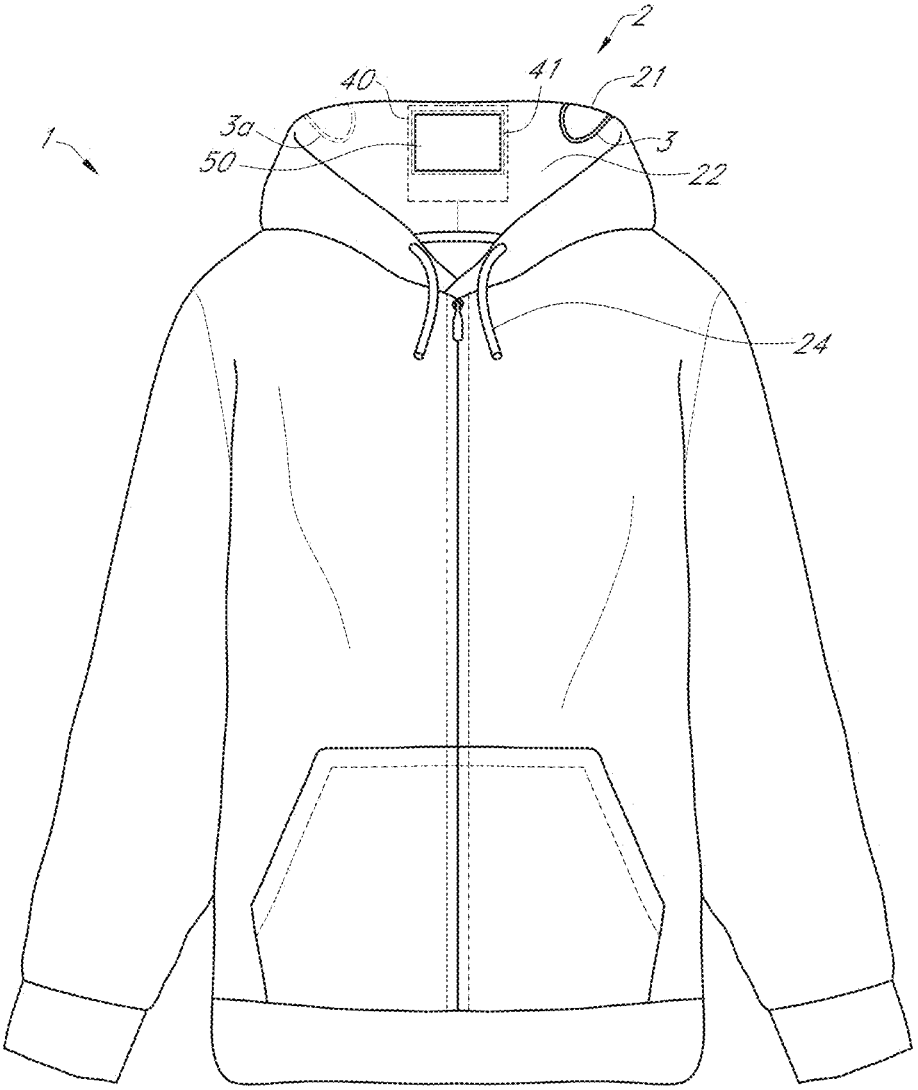
FIG. 1 is a front view of a garment including a hood with a mask portion.

A face mask desirably covers the nose and mouth of the mask wearer. Even more desirably, a typical face mask covers a portion of the wearer's face such as the lips, cheeks, jaw, chin, and/or neck and so forth. Examples of commonly used masks that cover the nose and/or mouth of a wearer include surgical masks, N95 masks, cloth masks, scarves, and neck gaiters, etc. These common types of masks are referred to herein generally as face masks or masks. Such face masks are often used effectively to prevent the inhalation of contaminants or pollution, prevent touching of ones face, for fashion purposes, protection from cold air and/or protection from UV rays, etc.

Most face masks are a separate item that a person must either wear or somehow carry with them in order to use. Many face masks are worn continuously for hours at a time, but others are taken on and off with some frequency. For example, masks can be taken on and off for purposes of moving between indoor and outdoor areas, eating, performing work activities, exercising, hiking, skiing, surfing, walking, snow play, cycling, gardening, etc. In certain activities, wearing a mask constantly is obtrusive and not recommended for either adults or children (e.g., working or exercising outdoors in intense heat).

One problem with typical masks is the inconvenience of having to carry a separate article (e.g., surgical or N95 mask, neck gaiter, scarf) when the mask is not being worn. Separate articles can be, and often are, accidentally forgotten, lost, destroyed, misplaced or left behind. Moreover, to carry the mask for later use, a person generally must have a receptacle such as a pocket, purse, backpack or additional item for stowing the face mask. The need for a receptacle is the same regardless of whether the mask is initially stowed and later removed for use or when the face mask first worn and then later removed. The need for a receptacle is also present whether the face mask is worn continuously and then removed or the mask is taken on and off frequently.

The need for a mask can rise unexpectedly. People may plan on exercising, playing or working in a secluded or unpopulated area and opt to not wear or carry a mask (or forget a mask). This expectation can change unexpectedly such that the person has a sudden need to wear a mask. For example, a person may encounter other people in the area, may need to enter indoor spaces, or need emergency services, etc. Even if the person has remembered to carry a mask it will still take time to find that mask, remove it from its receptacle, and don the mask. During this interval, the person may be exposed to the unwanted contaminants for which they are attempting to wear a mask. Changes in the weather can also create the unexpected need to use a mask. For example, a person may have forgotten to carry a scarf and the weather turns cold. or a person may have forgotten to carry sunscreen when out surfing, swimming, biking, hiking or engaging in other outdoor activities.

These problems are further exacerbated in the case of children. Children frequently lose masks and/or need an adult to carry their mask in a purse, backpack, pocket, etc. The time required for donning the masks is also increased. Both the adults and the children need time for safely finding, unfolding, and donning their masks.

When people forget their masks, one reaction is to attempt to cover their nose and mouth by pulling their shirt up over their nose or turning away from other people or merely maintaining distance between adjacent people. Both of these strategies has proven ineffective at preventing the transmission of contaminants. Furthermore, these are not options for dealing with unexpected changes in the weather. This is a major problem, especially when people are caught unexpectedly by passersby without a mask. As a result, people are frequently left feeling unsafe and ill-equipped to protect themselves, children, and seniors. Examples of this are common streets, trails, beaches, and elsewhere. In any location where people quickly need to don a mask to protect themselves, a regular face mask is often found to be inadequate. In short, regular face mask use is a nuisance for most and often impossible to remedy on short notice.

The present disclosure provides a solution to these problems and includes a recognition that there is an existing need for a more convenient face mask that can be part of an existing garment. One solution provided in the present disclosure is a hooded garment that can be worn and used as a mask. FIG. 1 illustrates a garment 1. The garment 1 can be any of various types of hooded garments. Examples of the garment 1 can include sweatshirt, rash guard, hooded coat, or other type of clothing with an attached or attachable hood. The material of the garment 1 can include cotton (e.g., 100%), polyester, cotton/polyester blends, spandex, silk, or blends any of various types of fabrics and/or filler materials and including breathable, thick fabrics. The garment 1 can generally include a trunk region, collar and one or more sleeves, although this is not required. The garment 1 can optionally include a front zipper, no zipper, sleeves, ribbed cuffs, ribbed bottom hem, front pocket, or other conventional features of a hooded garment.

The garment 1 can include a hood 2. The hood 2 can be attached with a upper end of the trunk region. The hood 2 can be coupled at a collar of the garment 1. The hood 2 can be made out of the same material or different material as the garment 1. The hood 2 can include a single layer, two layers, three layers or more layers of material. Any of the layers can be the same or comprise different material than the other layers. The material can be compact yarn, normal yarn, include warp and/or weft and/or varied thread counts depending on the materials desired. The hood 2 can be formed out of cotton, polyester, spandex blend, silk or blends of any type of fabric or material. Desirably, the hood 2 is made of a breathable filtration material. The breathable filtration material can protects the wearer from pathogens, fluids, and/or particulate matter floating in the air when worn across the nose and/or mouth. Desirably, the hood 2 can be made of material that provides protection against cold, harmful UV radiation from the sun, and/or other problems.

The hood 2 can include an edge 21. The edge 21 can include a hem of the material of the hood 2. The edge 21 can extend generally around an outer front periphery of the hood 2. The hood 2 can include a drawstring 24. The drawstring 24 can be disposed within a channel. The channel can extend along the edge 21. The drawstring 24 can comprise an elongate core material. The drawstring 24 can be tightened or loosened by the wearer by pulling on exposed ends of the drawstring 24.

The hood 2 can include a hood portion 22. The hood portion 22 can connect with the garment 21. Optionally, the hood 2 is removable from the garment 1 (e.g., via zippers or buttons). This can facilitate removal of the hood 2 (e.g., for ease of cleaning). The hood portion 22 can extend around the edge 21. The hood portion 22 can include a crown portion 25. The crown portion 25 can enclose a rear and/or upper portion of the hood 2. The crown portion 25 can include an apex 25*a*. The apex 25*a* can be spaced from the edge 21. The hood portion 22 can comprise one or more panels of material. The panels can be connected along one or more seams. A central seam 23 can connect opposite panels of the hood portion 22. The central seam 23 can be located in the crown portion 25. In certain implementations, the central seam 23 can extend from the edge 21 to the apex 25*a*.

The hood portion 22 can include a mask portion 40. The mask portion 40 can be sized to cover the nose and/or mouth a wearer. The mask portion can be a rectangular portion of the hood portion 22. The mask portion 40 can be located fully or partially within the crown portion 25. The mask portion 40 can overlap the crown seam 23. In certain implementations, the mask portion 40 can extend from the edge 21 to the apex 25*a*. One edge of the mask portion 40 can be aligned along the edge 21. An opposite edge can be spaced away from the edge 21 (e.g., towards the apex 25*a*). In other implementations, the mask portion 40 can take any shape and comprise any portion of the hood 22 and is not limited to a polygon shape. The mask portion 40 can comprise the same or different material, such as additional material, from the hood 2. That is, the mask portion 40 can comprise a portion of the hood 2 and need not be a separate element but instead comprise a portion of the hood material.

The mask portion 40 can comprise a breathable filtration material 50. The breathable filtration material 50 can extend over the entire area of the mask portion 40. The breathable filtration material 50 can comprise one or more layers of the same material as the hood portion 22. In certain implementations, the breathable filtration material 50 is the same material as the hood portion 22, without any additional material. In other implementations, the breathable filtration material 50 include additional material to the hood portion 22. The breathable filtration material 50 can include a cotton, polyester, spandex blend, silk or blends of any type of fabric or material. The breathable filtration material 50 can allow a wearer with the mask portion 40 positioned over the nose and/or mouth to inhale and exhale therethrough. The breathable filtration material 50 can filter out contaminants in the air. In certain implementations, the breathable filtration material 50 can filter airborne contaminants in accordance with relevant safety standards, such as YY/T0969 (China), YY/0469 (China), ASTM F2100 (USA), EN 14682 (Europe), NIOSH (42CFR84)(USA), GB2626 (China), EN 149: 2001 (Europe), or other N95, KN95, FFP1, or P2 mask standards. In certain implementations, the breathable filtration material 50 can filter airborne contaminants larger than: 3.0 microns≥95%, 0.3 microns≥95%, or 0.1 microns≥95%.

The breathable filtration material 50 can be coupled with the mask portion 40. The mask portion 40 can include a pocket 41. The pocket 41 can include two layers of material that form an internal pocket therebetween. The breathable filtration material 50 can be located within the pocket. The pocket 41 can include one or more edges that provide access into the internal pocket. The pocket 41 can include an opening and closing mechanism. The opening and closing mechanism can include a mechanical closure device such as a button, VELCRO® hook and loop fastener, pin, or other device. The mask portion 40 and/or the pocket 41 can include or be formed of a fabric including polypropylene, surgical mask material, or similar materials.

In certain implementations, the layers of the pocket 41 can be formed of the layers of the hooded portion 22. In one example, the hooded portion 22 can include an inner layer and an outer layer of material. The inner layer and the outer layer can form the pocket 41. Optionally the pocket 41 can include additional stitching or other closure devices for defining a smaller portion of the overall hood material 22 forming the pocket 41. In certain implementations, a pocket 41 can be accessible on the interior side of the hood 2. In other implementations, the breathable filtration material 50 can be attached with an interior layer of the hooded portion 22.

Figure 7:
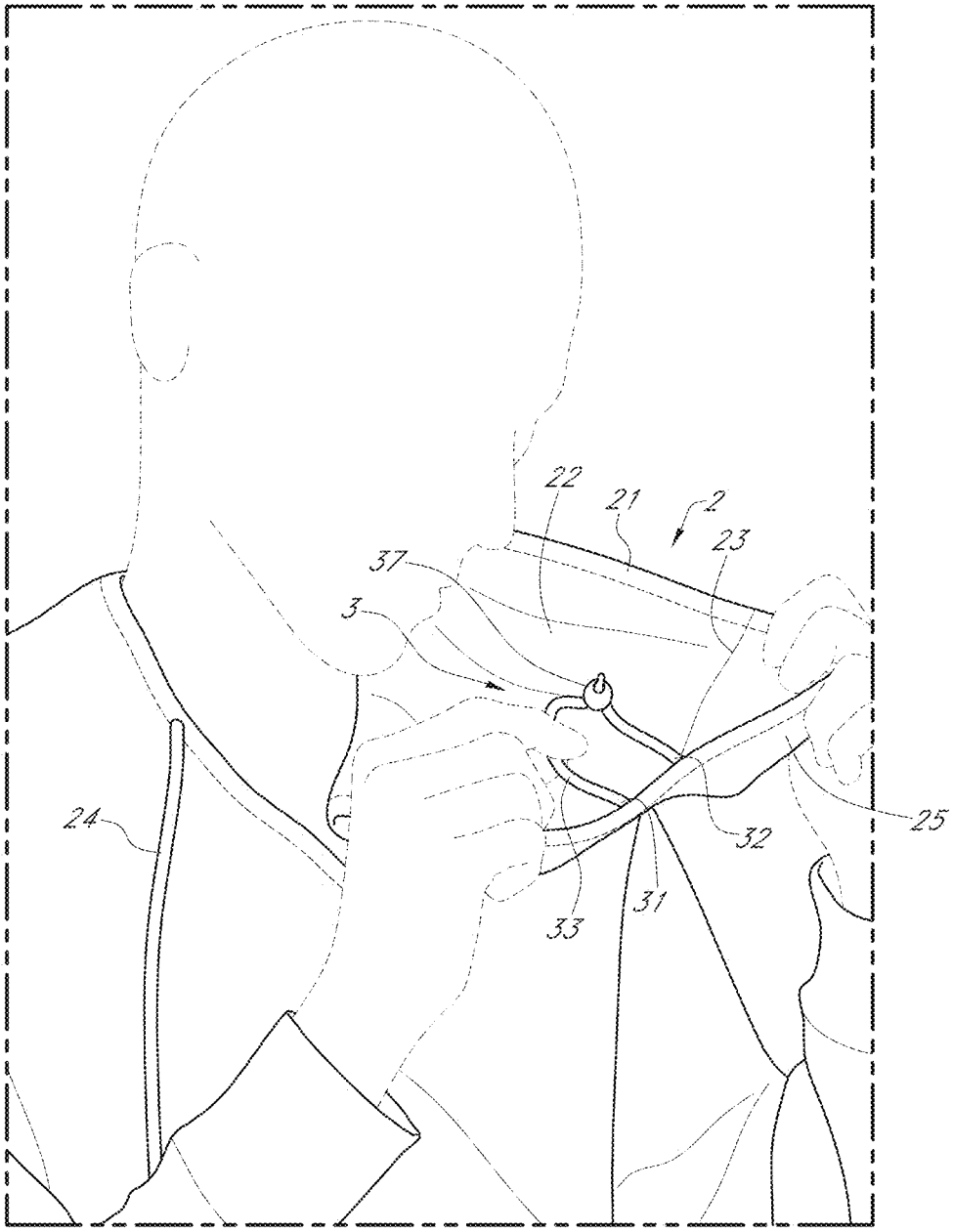
FIG. 7 is a front perspective view of the garment of FIG. 1 with the hood being pulled into the mask configuration.
Figure 8:
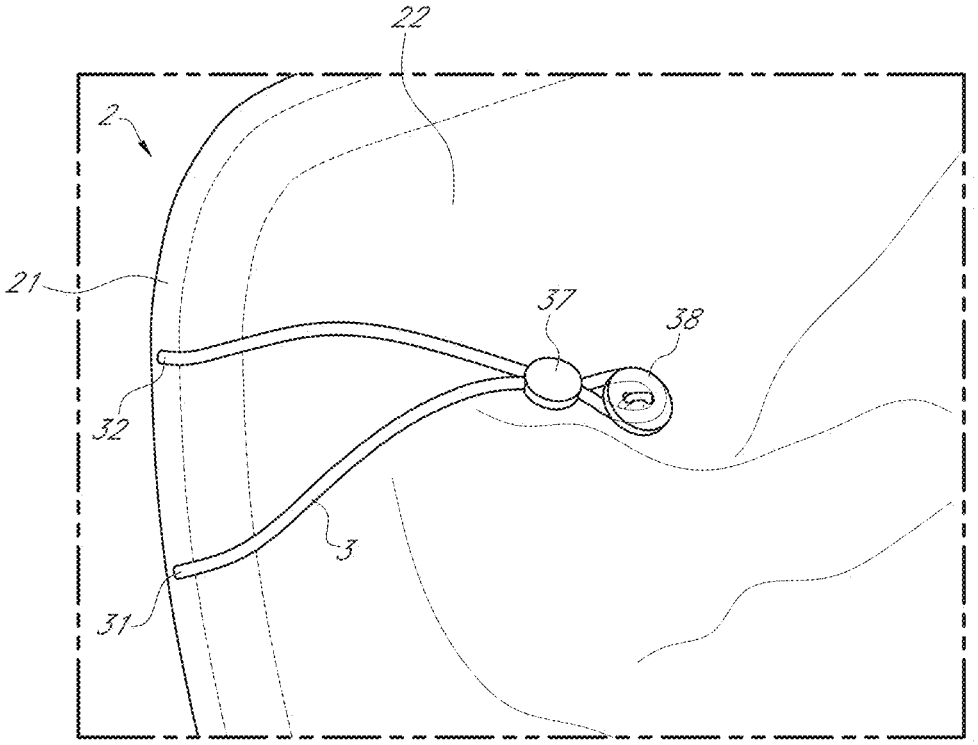
FIG. 8 shows an inner side of the hood with a securement for a tether.

The hood 2 can include an attachment mechanism or tether 3. The tether 3 can generally function to secure the hood in a mask configuration. The tether 3 can include a first end 31, a second end 32, and a body 33. The first and/or second ends 31, 32 can be coupled with the hood 2 (e.g., at the edge 21). The body 33 of the tether 3 can comprise a natural or synthetic material. In certain implementations, the body 33 can comprise an elastic or inelastic material. The tether 3 can be permanently or temporarily coupled with the hood 2 by one or more clamps, pins, hooks, hook and loop fastener, or other connecting device. The body 33 of the tether 3 can form a closed loop between the first and second ends 31, 32, as shown further in FIG. 3. The tether 3 can be adjustable in length (e.g., the size of the closed loop). In certain implementations, the tether 3 can include a spring toggle 37 (as shown in FIGS. 7-8) or other mechanism for adjusting the length of the tether 3. Optionally or in certain embodiments, the hood 2 can include a second tether 3*a*. The second tether 3*a* can have the same structure as the tether 3, but located on an opposite side of the hood 2 (e.g., along the edge 21 opposite the pocket 41).

Figure 2:
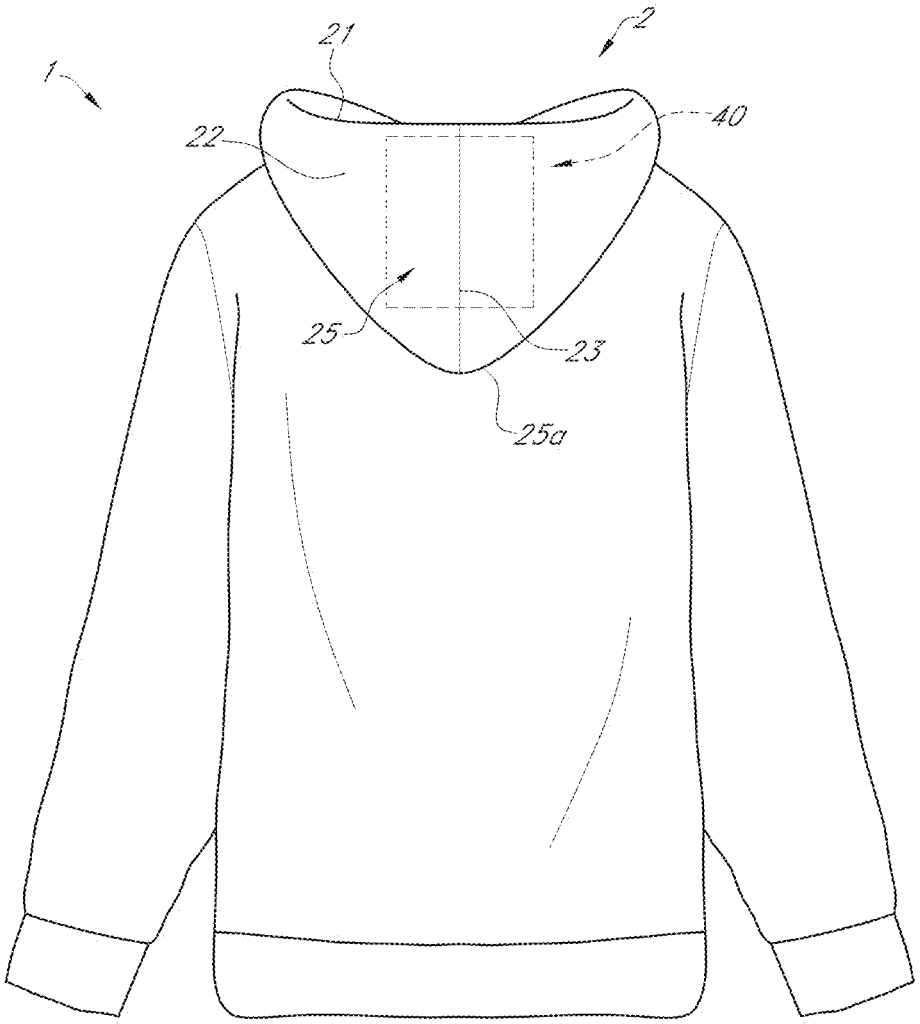
FIG. 2 is a rear view of the garment of FIG. 1 with the hood in a lowered position.
Figure 3:
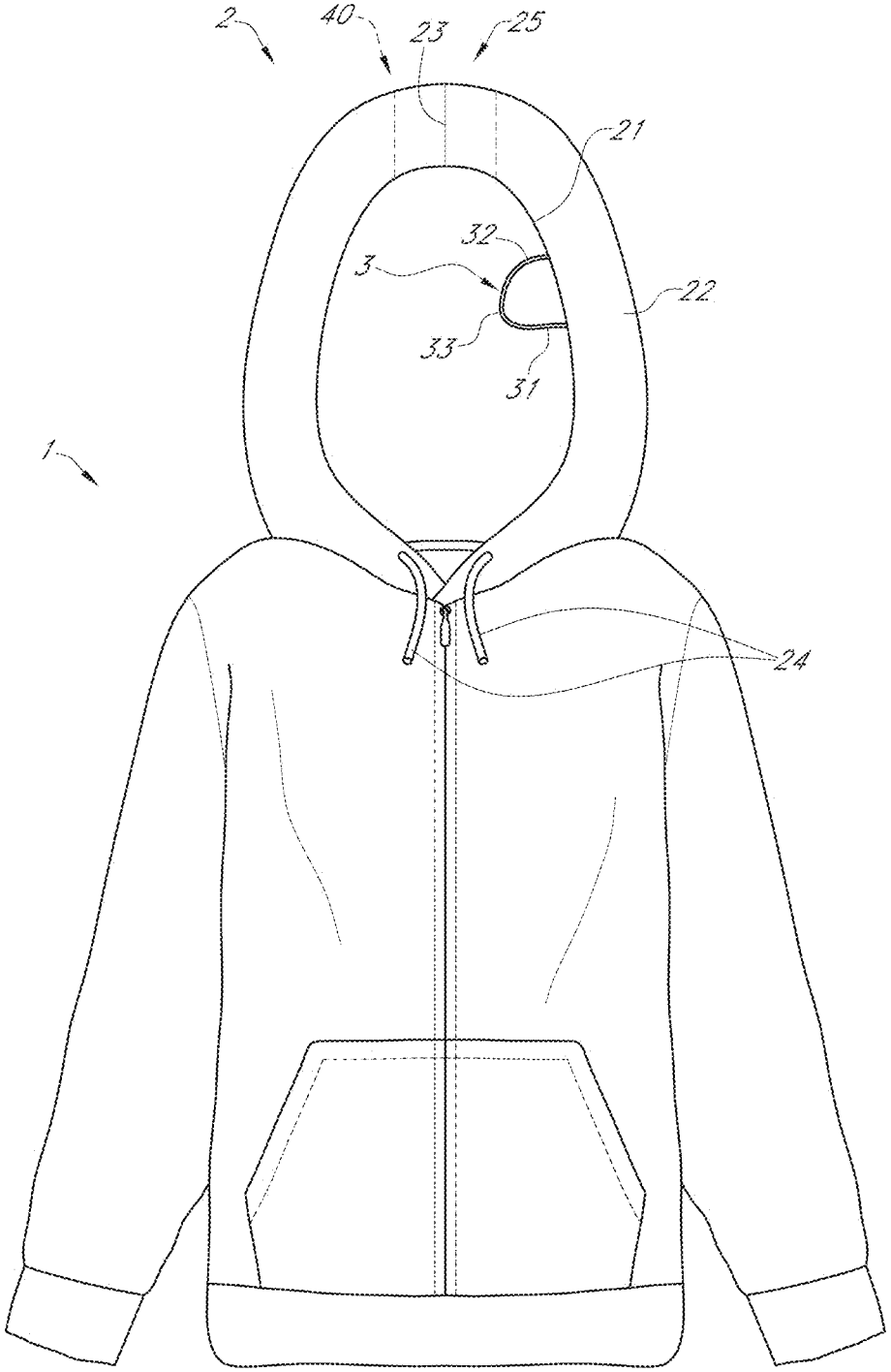
FIG. 3 is a front view of the garment of FIG. 1 with the hood in a raised position.
Figure 4:
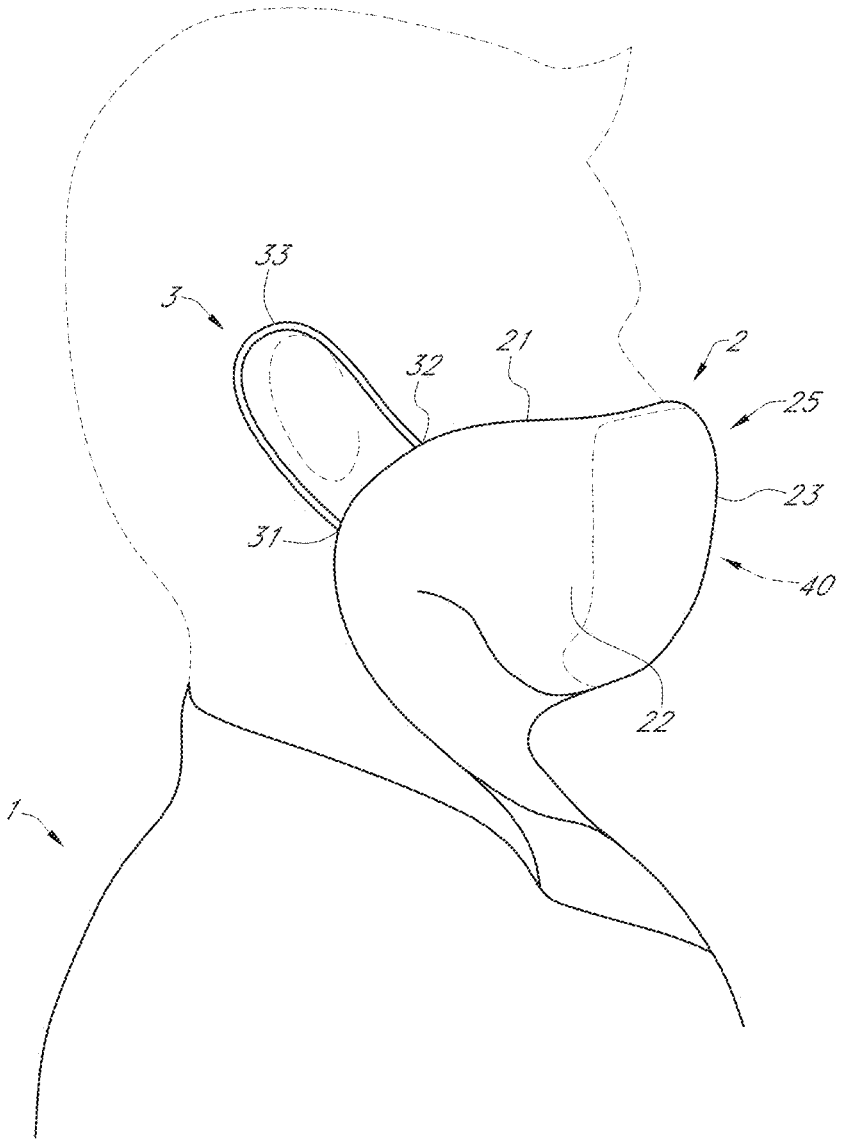
FIG. 4 is a side view of the garment of FIG. 1 with the hood arranged in a mask configuration.
Figure 5:
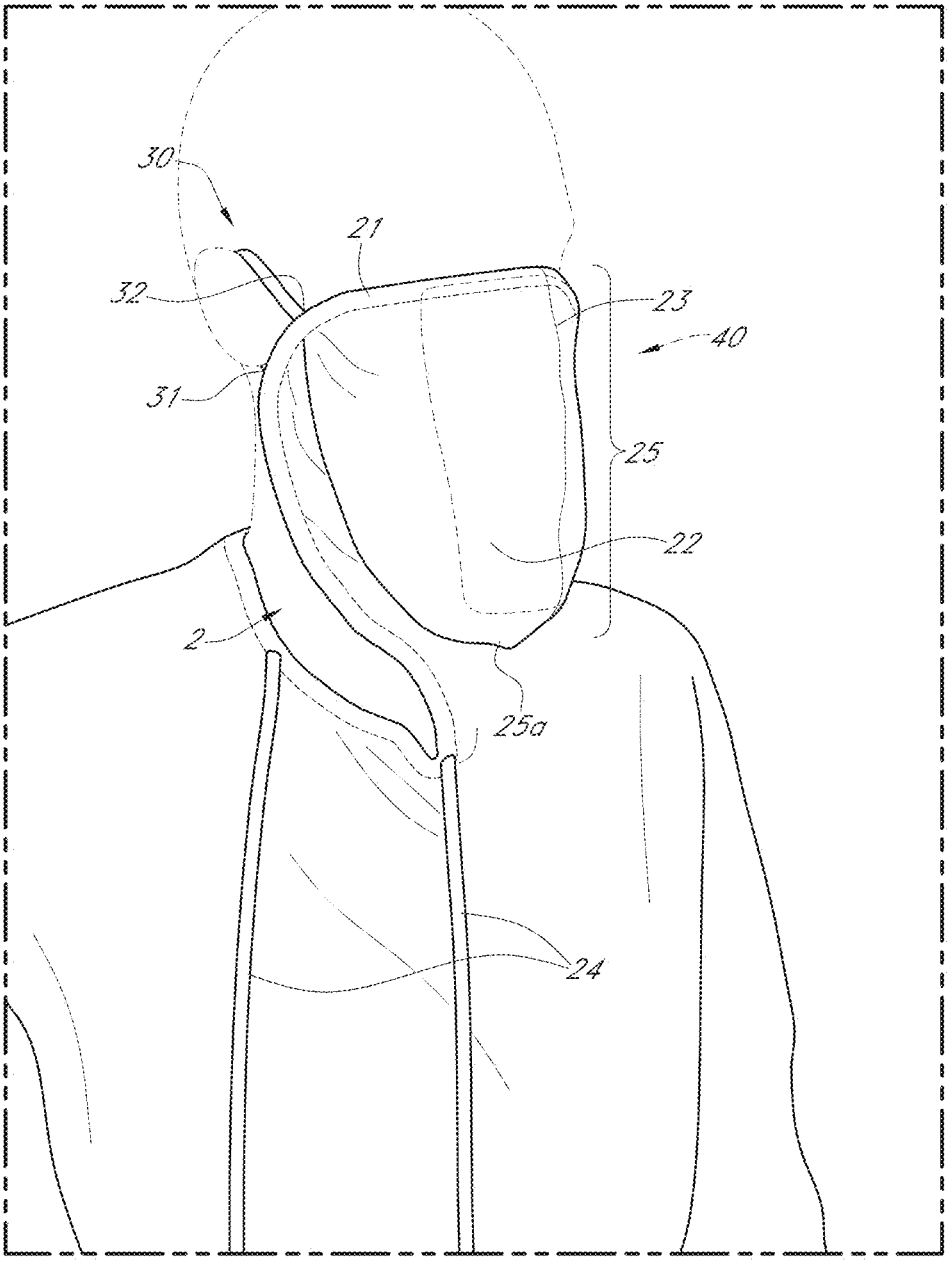
FIG. 5 is a front perspective view of the garment of FIG. 1 with the hood in the mask configuration.

The garment 1 and hood 2 can be used in the conventional manner. FIG. 3 illustrates the hood 2 in a raised position, over the head of a wearer, while FIGS. 1 and 2 illustrate the hood 2 in a lowered position. The hood 2 can be raised to protect the wearer from sun, cold, rain or other conditions or to obscure the head of the wearer. The mask portion 40 and the breathable filtration material 50 can be on the wearers head (e.g., top of the head). The tether 3 can be tucked underneath the hood portion 22 (e.g., under the edge 21 and/or within an internal pocket, pouch, retaining band or clamp therein); this can prevent the tether 3 from obscuring the vision of the wearer. Optionally, the drawstring 24 can be tightened and/or tied to draw the edge 21 around the face of the wearer. The hood 2 can also be lowered to rest on the back of the garment 1. In other implementations, the hood 2 can be fully removed from garment 1.

Alternative to the conventional uses of the hood 2, the hood 2 can be used in a mask configuration as shown in FIGS. 4-7. In the mask configuration, the hood 2 is drawn across the face (e.g., nose and/or mouth) of the wearer and secured in place therein by the tether 3. In the mask configuration, the crown portion 25 and/or the mask portion 40 can be generally aligned with the nose and/or mouth of the wearer. The apex 25*a* can be centrally aligned with the chin of the wearer. The central seam 23 can be aligned with the nose of the wearer. The edge 21 can extend over a first side or cheek of the wearer's face (under the eyes), across over the bridge of the nose, and across a second side or cheek of the wearer's face (under the eyes). An inside layer of the hood portion 22 or pocket 41 can be in contact with the wearer's face. The breathable filtration material 50 can be generally aligned with the wearer's nose and mouth such that the breathing of the wearer can be filtered through the breathable filtration material 50.

The positioning of the hood 2 on the wearer's face can be facilitated by the location of the tether 3 along the edge 21 and/or the length of the tether 3 (e.g., with or without adjusting the tether 3). In the mask configuration, the tether 3 can include a closed loop that hooks over the wearer's ear on the side of the wearer's face opposite the wrapping of the hood 2. Alternatively, the hood 2 can couple in other ways with the garment 1 and/or the hood 2. In certain implementations, the hood 2 can include a mechanical fastener such as a button, magnet, hook, VELCRO® hook and loop fastener, clamp or other fastening device and/or a corresponding fastening device on the garment 1 and/or the hood 2. The hood 2 can be secured in the mask configuration by the mechanical fastener. As another alternative, the tether 3 can comprise the drawstring 24. For example, the edge 21 can include one or more slits, holes, eyelets, grommets, button holes, or other apertures generally corresponding to the location between the first and second ends 31, 32 of the tether 3. A portion of the drawstring 24 can be exposed through the aperture(s) and removable from within the hem of the edge 21. The drawstring 24 can be looped around the wearer's ear similar to the tether 3 and/or tightened in place by adjusting the bottom ends of the drawstring 24. The bottom ends of the drawstring 24 can include one or more spring toggles (e.g., on one or both ends of the drawstring 24 or both ends together on a single spring toggle) that can be used to adjust the tensioning of the drawstring 24 when used in this configuration.

The wearer can transition the hood 2 from either the raised position or the lowered position to the mask configuration in very little time. In order to transition the hood 2 into the mask configuration, the wearer can grasp the hood 2, such as at the crown portion 25 or the tether 3, and wrap the hood 2 across a first side of the wearer's face, over the nose and mouth, under the eyes, and across a second side of the wearer's face (e.g., left to right or right to left). The tether 3 can be coupled with the ear on the second side of the wearer's face. The tether 3 can be coupled around the ear of the wearer (or otherwise with garment 1). The wearer can adjust a position or tightness of the hood 2 against the wearer's face by adjusting the tether 3 (e.g., adjusting a length, stretching, or otherwise adjusting the tether 3). In this manner, the tension of the hood 2 against the wearer's face can be easily adjustable using built-in features of the hood 2.

One advantage of the garment 1 is that the problem of stowing or losing a mask is significantly diminished. The garment 1 can be a garment that is habitually carried or worn by the wearer. Accordingly, when the hood 2 is in the lowered or raised positions, there is no problem of losing the mask because it is built into the garment 1. Accordingly, the wearer can quickly, easily, and reliably transition into the mask configuration to protect themselves from air pathogens, fluid pathogens, fluid and particulate matter, aerosols, cold air, harmful UV radiation and other problems.

Children and adults can remember their face mask hoodie even if they forget a mask. They can be protected when they exercise outside without pockets that are large enough to contain a normal face mask or if they forget their child's mask. The mask is always in two because it is part of worn garment. The two-in-one hoodie and mask can be utilized as both a hood and a mask. In certain implementations, the garment 1 can also include a second hood so that a first hood could be used in the raised or lowered positions and the second hood can be used in the mask configuration simultaneously.

In another implementation, the attachment device or tether 3 can be an attachment sold separately for retrofitting an existing garment 1 (e.g., hoodie). The attachment device can comprise a looped band made out of material that is elastic and/or inelastic and/or include a device for adjusting a length thereof such as a spring toggle. The attachment device can be secured to the hood such as along the edge or hem thereof, much like the attachment device on the hood 2 described above. In certain examples, the attachment device can include a clamp, clasp, hook and loop material, rivet or similar mechanical attachment devices for coupling with the hood. In another example, the attachment device can include a cloth or other material that can be sewn into the hood either manually or using a sewing machine.

Figure 6:
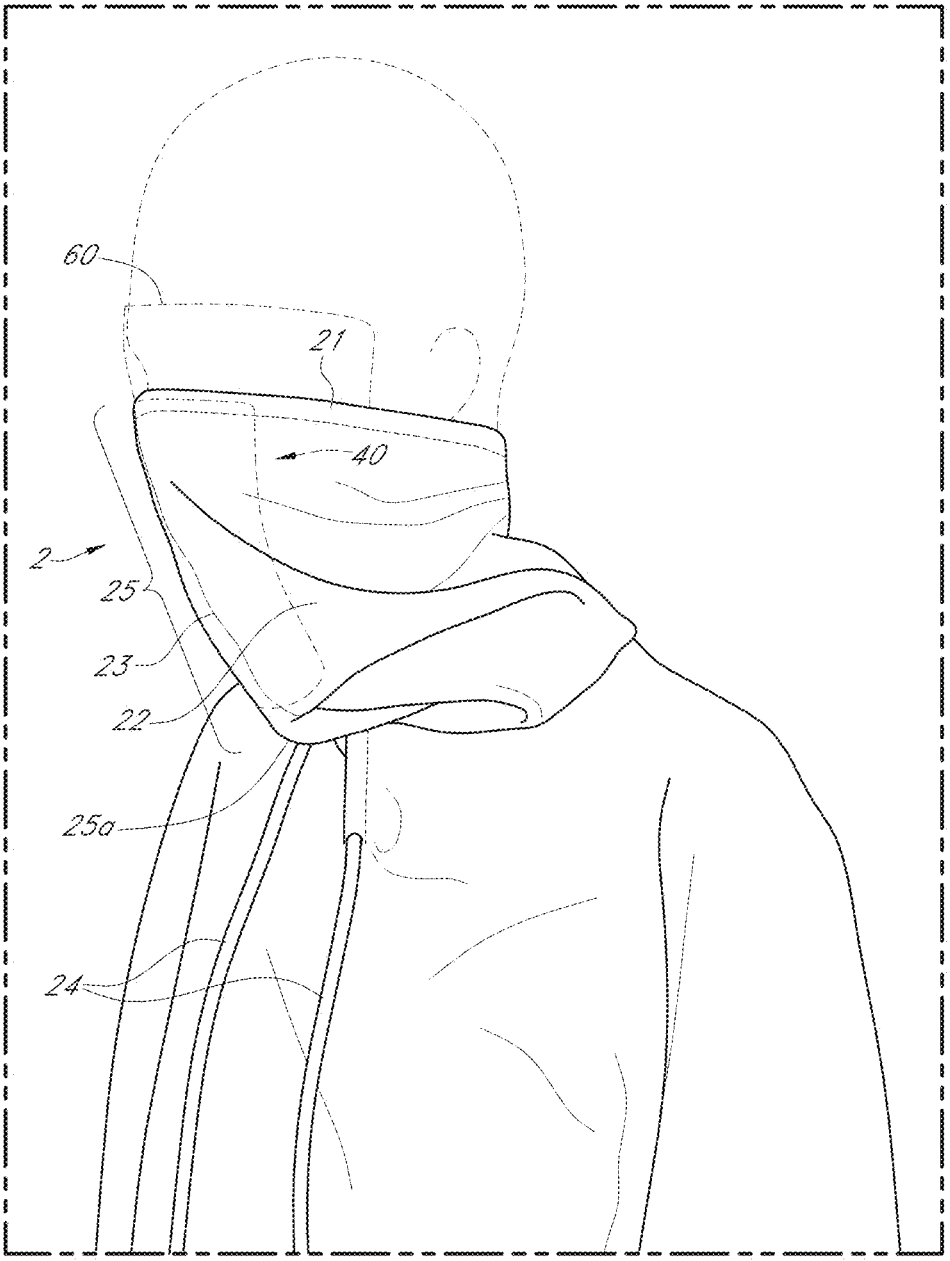
FIG. 6 is another front perspective view of the garment of FIG. 1 with the hood in the mask configuration.

As shown in FIG. 6, in certain implementations, the hood 2 can include a translucent or transparent portion 60. The translucent or transparent portion 60 can extend along the edge 21. The translucent or transparent portion 60 can extend along the edge 21. The translucent or transparent portion 60 can extend along the edge 21 within the crown portion 25 or the mask portion 40 of the hood 22. Accordingly, the translucent or transparent portion 60 can generally align over the eyes of the wearer in the mask configuration. The translucent or transparent material can be rigid such that it stands on end and can project upwardly and over and protection for the eyes of the wearer. In the raised or lowered positions, the translucent or transparent portion 60 can be folded under the edge 21. In the mask configuration, the translucent or transparent portion 60 can be unfolded to provide eye protection to the wearer.

FIG. 8 shows the hood 2 with an inner side of the hood portion 22 including a securement device 38. The securement device 38 can be a conventional button, snap button, hook and loop, hook, or other temporary mechanical connector. The securement device 38 can connect the inner side of the hood portion 22 with the tether 3 (e.g., when not in the mask configuration) to prevent dangling of the tether 3 and/or obstruction of the wearer's vision.

Figure 9:
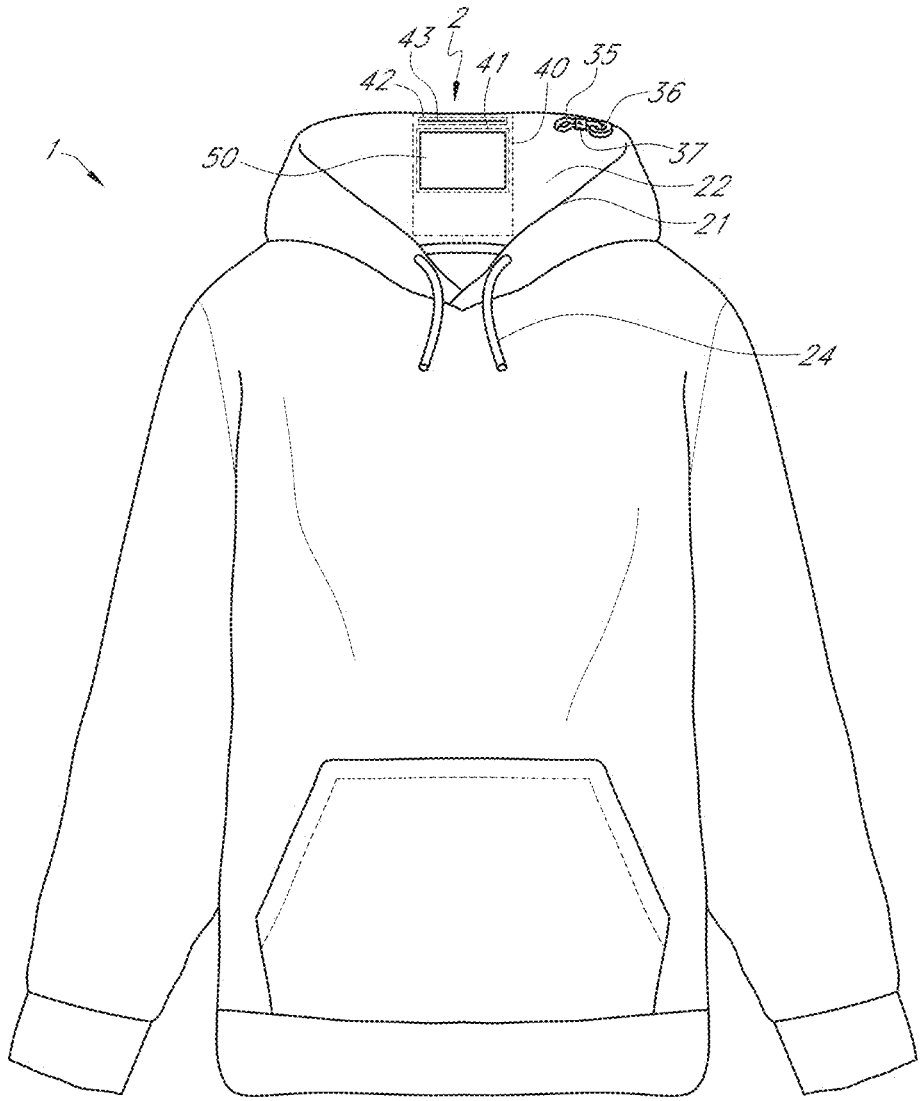
FIG. 9 is a front view of another embodiment of a garment with a hood having a mask portion and a tether.

FIG. 9 shows another configuration of the garment 1 with the additional elements and/or changes described below. The mask portion 40 can include a bridge pocket 42. The bridge pocket 42 can be attached with an inner side of the hood portion 22 or between layers thereof. The bridge pocket 42 can extend along and/or within the edge or hem 21 of the hood portion 22. The bridge pocket 42 can align with one side of the pocket 41 and/or be centered on the breathable filtration material 50 (and/or pocket 41). The bridge pocket 42 can be located between the edge 21 and the pocket 41.

The bridge pocket 42 is designed to hold a bridge strip 43. The bridge strip 43 can be a formed of metal, plastic or another material. The bridge strip 43 can be a thin and/or bendable strip of material. The bridge strip 43 can align with the bridge of a wearer's nose in the mask configuration of the hood 2. The bridge strip 43 can be bent to conform closely to the shape of the wearer's face (e.g., bridge of the nose). Optionally, the bridge strip 43 can be removable and replaceable from within the bridge pocket 42.

The garment 1 can include one or more eyelets 36 on or adjacent the edge 21. The drawstring 24 can pass through eyelet(s) 36 to be used as a tether 35, like the tether 3. The tether 35 can include an end loop (e.g., to hook on the wearer's ear) and/or the spring toggle 37 to adjust a length of the end loop or the length of the tether 35. In one version, the drawstring is drawn through a single eyelet (e.g., as a loop). In another version, the drawstring 24 exits the hem or edge 21 through a first eyelet 36 and returns through a second eyelet 36 and forms the end loop therebetween. The length of the tether 35 can be adjustable by drawing more or less drawstring 24 through the eyelet(s) 35.

Figure 10:
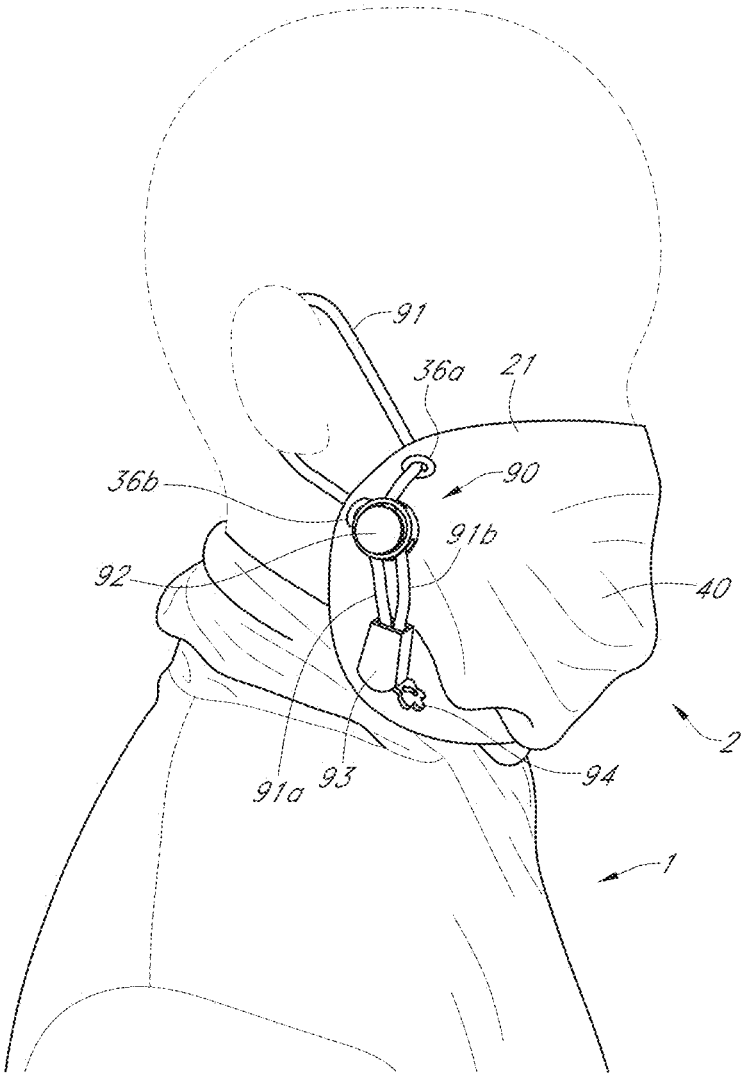
FIG. 10 is a side view of another embodiment of a garment with a hood having a mask portion and a tether having a spring toggle.

FIG. 10 shows another configuration of the garment 1 with the additional elements and/or changes described below. The garment 1 can include another version of a tether 90. The tether 90 can include an elongate member, such as a cord. The tether 90 can be formed of an elastic or inelastic material. The tether 90 can include first and second ends 91*a*, 91*b*. The first and second ends 91*a*, 91*b* can extend through one or more eyelets 36*a*, 36*b* in the hood 2.

The tether 90 can include an ear loop 91. The ear loop 91 can coupled with a wearer's ear in the mask configuration. The size of the ear loop 91 can be adjusted by a spring toggle 92 or other adjustment device. This adjustment can adjust the tension of the mask against the wearer's face in the mask configuration.

Figure 11:
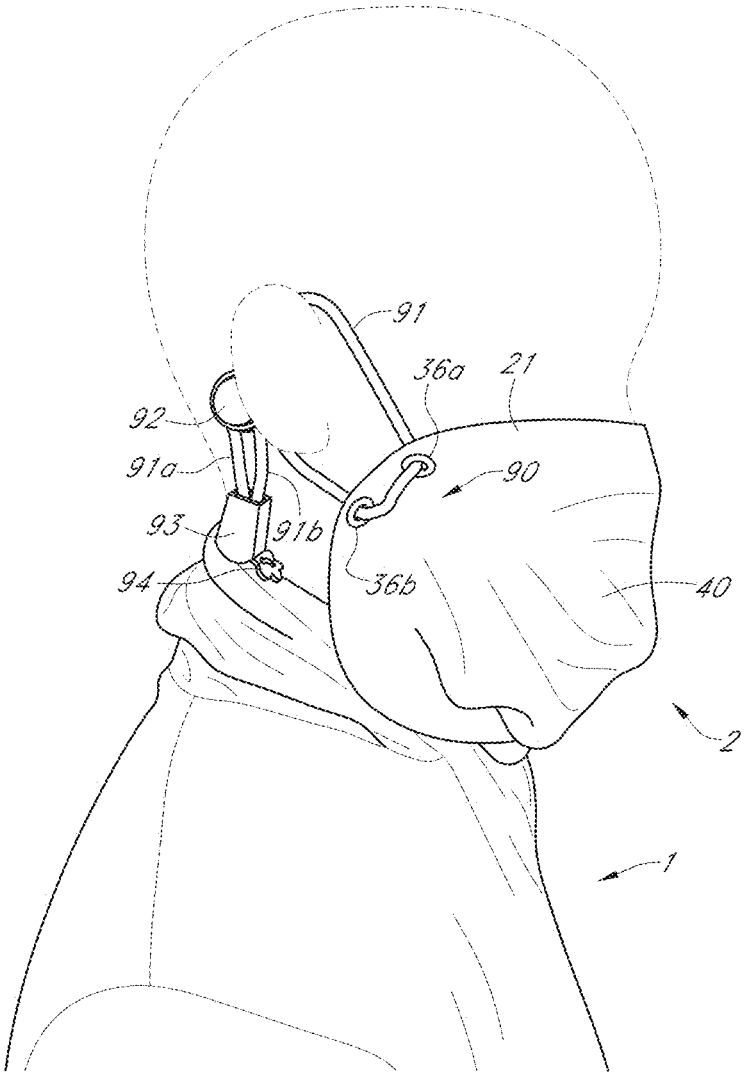
FIG. 11 is a side view of the garment of FIG. 10 with the spring toggle positioned behind a wearer's ear.

First and second ends 91*a*, 91*b* of the tether 90 can be coupled together by a clamp 93. Optionally a button 94 can be attached with the clamp. When not in the mask configuration, the tether 90 can be secured within the hood 2 by the securement device 38 described above. Optionally the spring toggle 92, the clamp 93, the button 94 or another portion of the tether 90 can be coupled with the securement device 38. The spring toggle 92 can be place anywhere on the tether 90. In certain examples, the spring toggle 92 can be located on the hood side of the edge 21 (as illustrated) or on the ear loop 91, such as behind the ear of the wearer (as shown in FIG. 11).

What is claimed is:

1. A method of donning a mask comprising:

wrapping a hood of a garment around a first side of a wearer's face across a nose and mouth area of the wearer's face and across a second side of the wearer's face and securing a tether coupled to an edge of the hood to the wearer's ear to secure the hood in a position where a crown portion of the hood covers the nose and mouth area of the wearer's face, wherein the crown portion of the hood comprises a mask portion comprising a breathable filtration material configured to filter airborne contaminants, wherein the tether includes a first end and a second end, the first end configured to be attached with the edge of the hood and the second end configured to be attached with the edge of the hood to form a loop, the loop configured to couple with the wearer's ear on the second side of the head of the wearer.

2. The method of claim 1, further comprising aligning the mask portion of the hood with the nose and mouth portion of the wearer's face.

3. The method of claim 1, further comprising adjusting a length of the tether to tension the hood across the wearer's face.

4. The method of claim 3, further comprising inserting the breathable filtration material into a pocket, the pocket disposed within the mask portion of the hood such that respiration of the wearer is through the breathable filtration material.

5. The method of claim 4, wherein the pocket is formed by an inner layer of material of the hood and an outer layer of material of the hood.

6. The method of claim 4, wherein the pocket includes a closeable and openable interface for opening and closing the pocket so the breathable filtration material can be inserted into the pocket.

7. The method of claim 1, wherein the tether further comprises a spring toggle configured to adjust a length of the loop.

8. The method of claim 1, wherein the mask portion is aligned along a crown seam of the crown portion between a first panel and a second panel of the hood and the mask portion extends from the edge of the hood to an apex of the hood.

9. The method of claim 1, wherein the hood includes an inner layer of material and an outer layer of material and the inner layer of material is in contact with the wearer's face when the crown portion of the hood covers the nose and mouth area of the wearer's face.

* * * * *